US011814984B2

(12) United States Patent
Okui et al.

(10) Patent No.: US 11,814,984 B2
(45) Date of Patent: Nov. 14, 2023

(54) ROTOR AND COMPRESSOR

(71) Applicant: Mitsubishi Power, Ltd., Kanagawa (JP)

(72) Inventors: Hidetaka Okui, Kanagawa (JP); Kondo Takahiro, Kanagawa (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 43 days.

(21) Appl. No.: 17/615,362

(22) PCT Filed: May 27, 2020

(86) PCT No.: PCT/JP2020/020829
§ 371 (c)(1),
(2) Date: Nov. 30, 2021

(87) PCT Pub. No.: WO2020/250674
PCT Pub. Date: Dec. 17, 2020

(65) Prior Publication Data

US 2022/0228497 A1 Jul. 21, 2022

(30) Foreign Application Priority Data

Jun. 12, 2019 (JP) ..... 2019-109899

(51) Int. Cl.
*F01D 5/30* (2006.01)
*F04D 17/10* (2006.01)
(Continued)

(52) U.S. Cl.
CPC ..... *F01D 5/3007* (2013.01); *F04D 17/10* (2013.01); *F04D 29/34* (2013.01); *F01D 5/3015* (2013.01);
(Continued)

(58) Field of Classification Search
CPC ..... F01D 5/3007; F01D 5/30; F01D 5/3015; F04D 29/34; F04D 29/322
See application file for complete search history.

(56) References Cited

U.S. PATENT DOCUMENTS 7,905,709 B2 * 3/2011 Lagrange ..... F01D 5/3007 416/219 R
8,734,101 B2 * 5/2014 McDonald ..... F04D 29/542 415/209.4
(Continued)

FOREIGN PATENT DOCUMENTS

JP 63-98403 6/1988
JP 63-138403 9/1988
(Continued)

OTHER PUBLICATIONS

English translation of International Search Report dated Jul. 14, 2020 in corresponding International (PCT) Patent Application No. PCT/JP2020/020829.
(Continued)

*Primary Examiner* — Justin D Seabe
*Assistant Examiner* — Behnoush Haghighian
(74) *Attorney, Agent, or Firm* — Wenderoth, Lind & Ponack, L.L.P.

(57) ABSTRACT

A rotor has formed therein a groove with which a moving blade including a dovetail portion and a platform portion connecting the dovetail portion and a blade portion engages. The groove opens in a surface intersecting the axis of rotation of the rotor, and includes a contacting portion extending obliquely with respect to the axis of rotation and coming into contact with the dovetail portion, a bottom portion of an end portion on the radially inner side of the rotor, a joining portion between the contacting portion and the bottom portion, a platform facing portion facing the platform portion, and a chamfered portion formed on an end
(Continued)

surface in the groove-extending direction. The chamfered dimension of the joining portion is greater on the side with an acute angle between the groove and the end surface than on the side with an obtuse angle between the groove and the end surface.

12 Claims, 10 Drawing Sheets

(51) Int. Cl.
*F04D 29/34* (2006.01)
*F04D 29/32* (2006.01)

(52) U.S. Cl.
CPC ..... *F04D 29/322* (2013.01); *F05D 2220/32* (2013.01); *F05D 2240/24* (2013.01)

(56) References Cited

U.S. PATENT DOCUMENTS 9,810,077 B2 * 11/2017 Murdock ..... F01D 5/3007
10,876,405 B2 * 12/2020 Yoshida ..... F01D 25/00
2013/0195669 A1 * 8/2013 Murdock ..... F01D 5/3007 416/223 R
2016/0032739 A1 2/2016 Sekihara et al.
2016/0333707 A1 * 11/2016 Holzhaeuser ..... F01D 5/3007
2019/0003309 A1 * 1/2019 Yoshida ..... F01D 5/005

FOREIGN PATENT DOCUMENTS

JP 2010-190199 9/2010
JP 2016-35209 3/2016
WO 2017/119358 7/2017

OTHER PUBLICATIONS

English translation of Written Opinion dated Jul. 14, 2020 in corresponding International (PCT) Patent Application No. PCT/JP2020/020829.

* cited by examiner

ROTOR AND COMPRESSOR

TECHNICAL FIELD

The present invention relates to a rotor and a compressor.

BACKGROUND ART

In rotary machines such as gas turbines and compressors, the rotor blades are fixed to a rotor fixed to a rotating shaft, and the rotating shaft, the rotor, and the rotor blades rotate integrally. Here, a dovetail portion is inserted into a groove formed in the rotor, to fix the rotor blade to the rotor. A structure of the rotor blade has been proposed to prevent stress from being concentrated at the dovetail portion, which is a portion to be connected to the rotor, during rotation of the rotor, and from causing damage.

For example, Japanese Unexamined Patent Application Publication No. 63-98403 describes a structure in which a blade root is formed in an S-shape that is line-symmetrical with respect to a central axis, a chamfered portion is provided on a blade root side in a part of the S-shape, and a chamfered portion is provided on a rotor side in another portion.

As described in Japanese Unexamined Patent Application Publication No. 63-98403, when an axial end portion of a contact surface between the groove of the rotor and the blade root of the rotor blade is chamfered to prevent the groove and the blade root from coming into contact with each other, stress concentration at the axial end portion can be suppressed, and the occurrence of damage can be suppressed.

Here, there is room for improvement in the structure of the contact surface between the groove of the rotor and the blade root of the rotor blade. In addition, since the groove of the rotor and the blade root of the rotor blade are rotating portions, the structure in which chamfers are provided to achieve a non-contact state therebetween may cause a turbulence of a fluid, causing a reduction in the efficiency of the rotary machine.

The present invention has been made to solve the above-described problems, and an object of the present invention is to provide a rotor and a compressor capable of suppressing a cause of a turbulence of a fluid and suppressing stress concentration.

SUMMARY OF THE INVENTION

According to an aspect of the present invention, to achieve the above object, there is provided a rotor in which a groove is formed with which a rotor blade meshes, the rotor blade including a dovetail portion and a platform portion that connects the dovetail portion and a blade portion. The groove includes a contact portion that is open to a surface intersecting a rotation axis of the rotor, that extends to be inclined with respect to the rotation axis, and that increases in width toward a rotor radial inner side to be in contact with the dovetail portion, a bottom portion that is an end portion on the rotor radial inner side, a connecting portion between the contact portion and the bottom portion, a platform-facing portion located on a rotor radial outer side of the contact portion to face the platform portion, and a chamfered portion formed in an end surface of the groove in an extending direction. A chamfer dimension of the connecting portion is larger on a side on which an angle formed by the groove and the end surface is an acute angle than on a side on which an angle formed by the groove and the end surface is an obtuse angle.

It is preferable that a dimension of the chamfered portion of the connecting portion on the side on which the angle formed by the groove and the end surface is an acute angle is larger than a dimension of the chamfered portion of the platform-facing portion on the side on which the angle formed by the groove and the end surface is an acute angle.

It is preferable that a dimension of the chamfered portion of the connecting portion on the side on which the angle formed by the groove and the end surface is an acute angle is larger on an upstream side in a gas flow direction than on a downstream side in the gas flow direction.

It is preferable that a dimension of the chamfered portion of the connecting portion is a dimension at a position at which a distance between the chamfered portion and a facing surface of the groove is at its maximum.

It is preferable that the chamfered portion is formed on an entire periphery of the end surface.

It is preferable that a dimension of the chamfered portion of the connecting portion on the side on which the angle formed by the groove and the end surface is an acute angle is larger than dimensions of the chamfered portions of other portions.

It is preferable that chamfer dimensions of the contact portion and the connecting portion are larger on the side on which the angle formed by the groove and the end surface is an acute angle than on the side on which the angle formed by the groove and the end surface is an obtuse angle.

It is preferable that a chamfer dimension from the platform-facing portion to the connecting portion is larger on the side on which the angle formed by the groove and the end surface is an acute angle than on the side on which the angle formed by the groove and the end surface is an obtuse angle.

It is preferable that the platform-facing portion includes a shape facing a shank portion of the rotor blade between the platform portion and the dovetail portion.

It is preferable that the contact portion of the groove has a multi-stage structure in which a non-contact portion is provided on the rotor radial inner side of the connecting portion and the contact portion is further provided on the rotor radial inner side of the non-contact portion.

According to an aspect of the present invention, to achieve the above object, there is provided a compressor including: the rotor according to any one of the above descriptions; and a rotor blade of which a blade root engages with the rotor.

It is preferable that the rotor blade includes a blade portion, a platform portion connected to a root side of the blade portion and having a surface parallel to a centrifugal force application direction of the blade portion, and a dovetail portion connected to the platform portion and disposed on a radial inner side of the platform portion.

According to the present invention, a cause of a turbulence of a fluid and stress concentration can be suppressed.

DETAILED DESCRIPTION OF EMBODIMENTS

An exemplary embodiment of a rotor blade body and a rotary machine according to the present invention will be described in detail below with reference to the accompanying drawings. However, the present invention is not limited by the embodiment, and in the case of a plurality of embodiments, the present invention also includes a combination of the embodiments.

Figure 1:
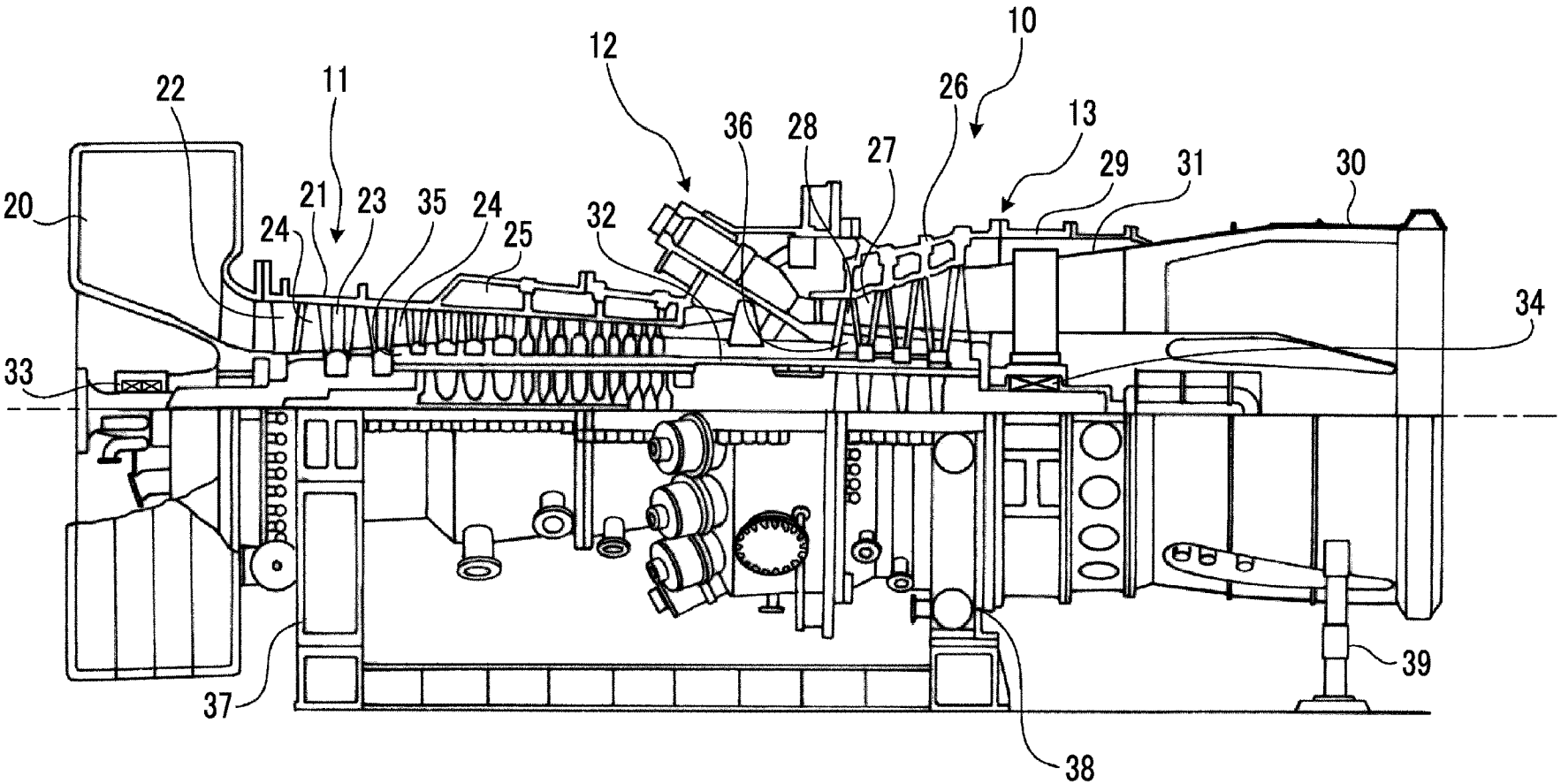
FIG. 1 is a schematic view illustrating a schematic configuration of a gas turbine equipped with a rotor and a compressor according to the present embodiment.

FIG. 1 is a schematic configuration view illustrating a gas turbine equipped with a rotor blade body according to an embodiment of the present invention. As illustrated in FIG. 1, a gas turbine 10 includes a compressor 11, a combustor 12, and a turbine 13. A generator is connected to the gas turbine 10, so that the generator is capable of generating electric power.

The compressor 11 includes an air intake port 20 that takes in air. Inside a compressor compartment 21, an inlet guide vane (IGV) 22 is disposed, and a plurality of stator blades 23 and rotor blades 24 are alternately disposed in a front to rear direction (axial direction of a main shaft 32 to be described later), and an air bleeding chamber 25 is provided outside the compressor compartment 21. In the combustor 12, fuel is supplied to the compressed air compressed by the compressor 11, and is ignited therewith to be combustible. In the turbine 13, a plurality of stator blades 27 and rotor blades 28 are alternately disposed in the front to rear direction (axial direction of the main shaft 32 to be described later) inside a turbine compartment 26. An exhaust chamber 30 is disposed downstream of the turbine compartment 26 via an exhaust compartment 29, and the exhaust chamber 30 includes an exhaust diffuser 31 that is continuous with the turbine 13.

In addition, the main shaft 32 is located to penetrate through central portions of the compressor 11, the combustor 12, the turbine 13, and the exhaust chamber 30. An end portion on a compressor 11 side of the main shaft 32 is rotatably supported by a bearing member 33, and an end portion on an exhaust chamber 30 side is rotatably supported by a bearing member 34. A plurality of rotor discs 35 in which the rotor blades 24 are mounted are placed over and fixed to the main shaft 32 in the compressor 11, and a plurality of rotor discs 50 in which the rotor blades 28 are mounted are placed over and fixed to the main shaft 32 in the turbine 13. A drive shaft of the generator (not illustrated) is connected to the end portion on the exhaust chamber 30 side.

In the gas turbine, the compressor compartment 21 of the compressor 11 is supported by legs 37, the turbine compartment 26 of the turbine 13 is supported by legs 38, and the exhaust chamber 30 is supported by legs 39.

Therefore, the air taken in from the air intake port of the compressor 11 is compressed while passing through the inlet guide vane 22, and the plurality of stator blades 23 and rotor blades 24, to become high-temperature and high-pressure compressed air. In the combustor 12, a predetermined fuel is supplied to the compressed air and is combusted. High-temperature and high-pressure combustion gas (working fluid) that is a working fluid generated by the combustor 12 passes through the plurality of stator blades 27 and rotor blades 28 forming the turbine 13, to drive and rotate the main shaft 32, and to drive the generator connected to the main shaft 32. On the other hand, energy of exhaust gas (combustion gas) is reduced in speed by the conversion of the exhaust gas into pressure by the exhaust diffuser 31 of the exhaust chamber 30, and then is released to the atmosphere.

Figure 2:
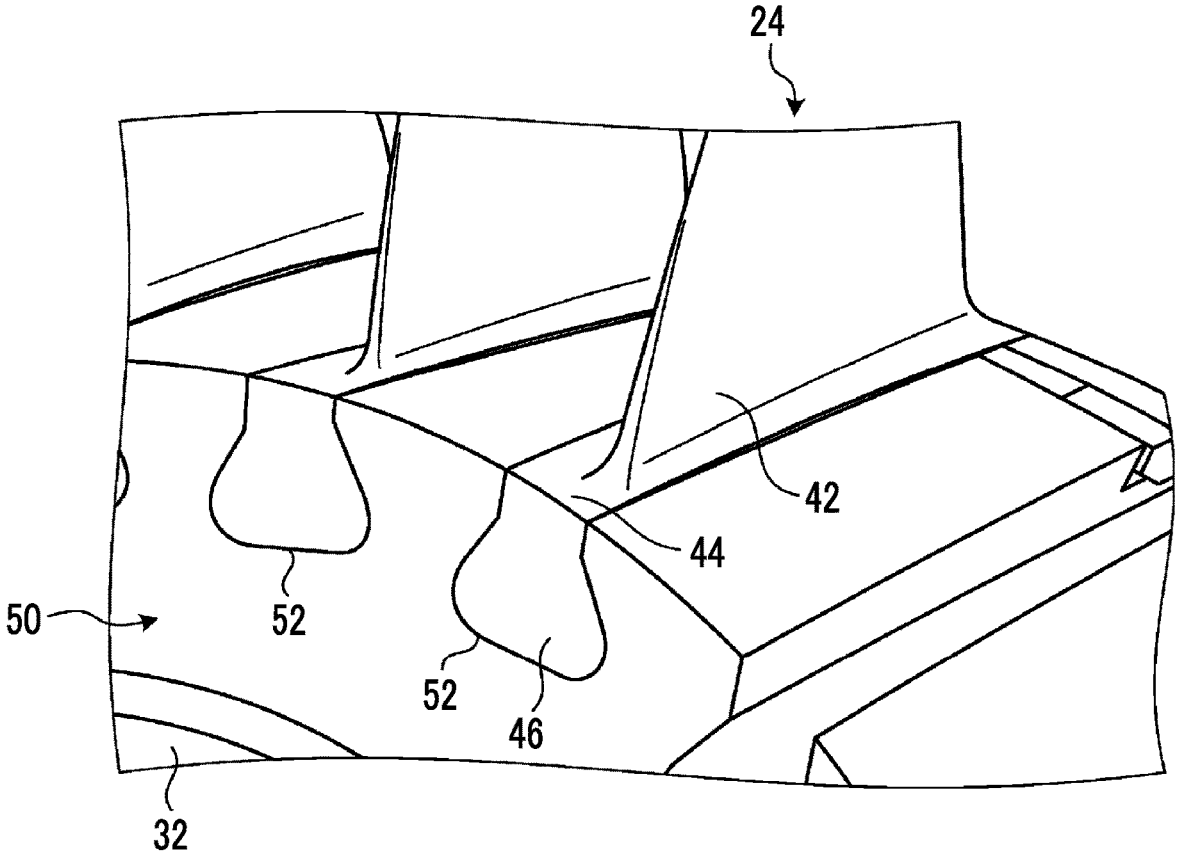
FIG. 2 is a perspective view illustrating the vicinity of rotor blades of the compressor.
Figure 3:
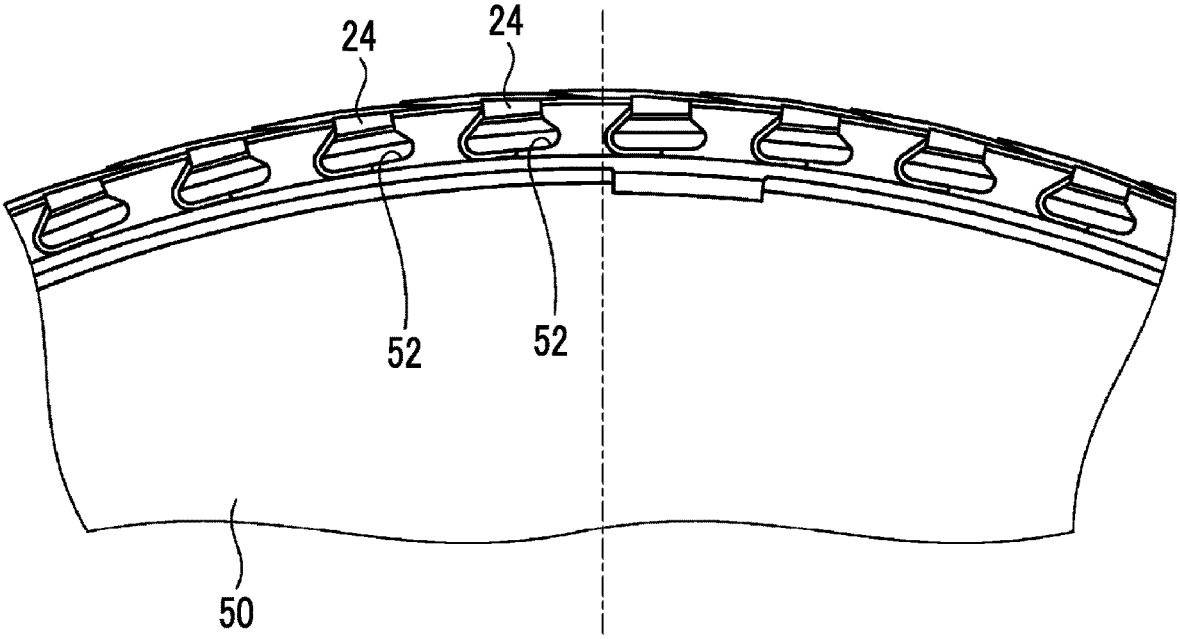
FIG. 3 is a schematic view of the compressor as seen in an axial direction.
Figure 4:
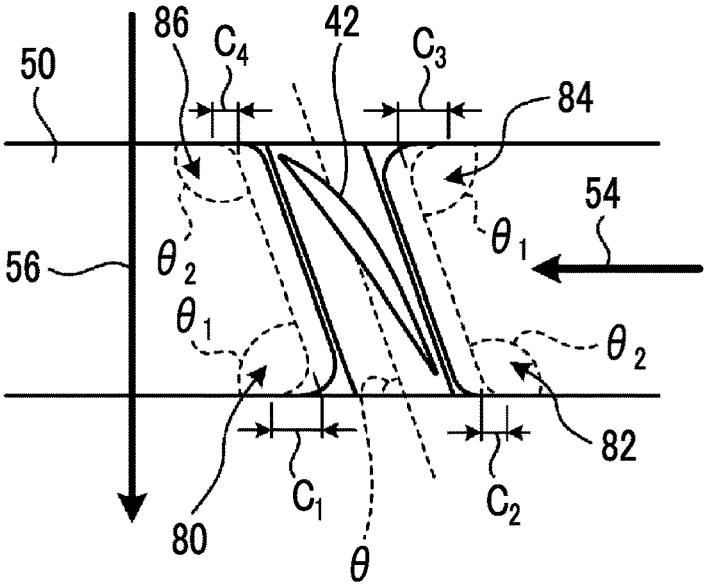
FIG. 4 is a schematic view of the compressor as seen in a radial direction.
Figure 5:
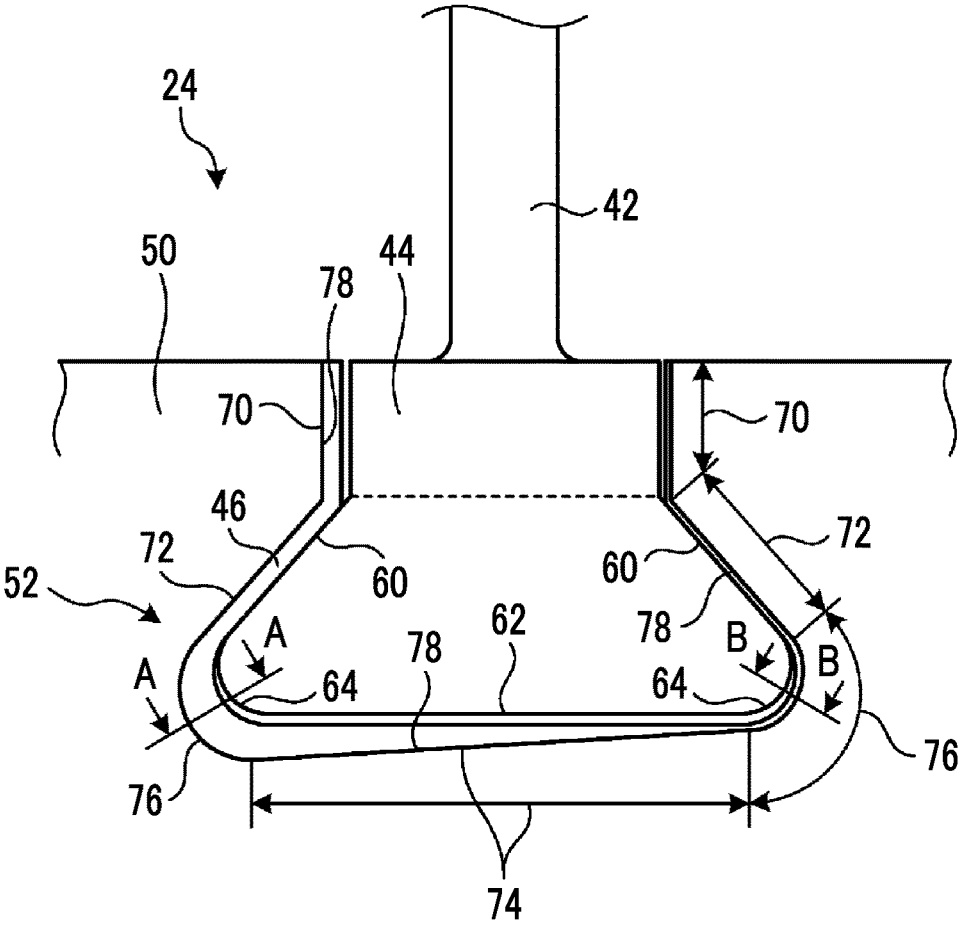
FIG. 5 is a schematic view of a dovetail portion and a groove as seen in the axial direction.

Next, the rotor of the present embodiment will be described with reference to FIGS. 2 to 5. FIG. 2 is a perspective view illustrating the vicinity of the rotor blades of the compressor. FIG. 3 is a schematic view of the compressor as seen in the axial direction. FIG. 4 is a schematic view of the compressor as seen in a radial direction. FIG. 5 is a schematic view of a dovetail portion and a groove as seen in the axial direction.

The rotor of the present embodiment is applied to the compressor 11 of the gas turbine 10. The rotor of the present embodiment is a rotor disc 50 fixed to the main shaft 32. In the present embodiment, the rotor is the rotor disc 50 that is a separate member from the main shaft 32, and is structured to be fixed to the main shaft 32, but is not limited thereto. The rotor may be a structure to which the rotor blades 24 are fixed and which rotates with the rotor blades 24, and the main shaft 32 may serve as the rotor.

As illustrated in FIGS. 2 to 4, the compressor 11 includes the rotor disc 50 that can rotate integrally with the main shaft 32, and the plurality of rotor blades 24 mounted to extend radially from an outer peripheral portion of the rotor disc 50. The rotor blade 24 is inserted into a groove 52 formed in the rotor disc 50.

The rotor blade 24 includes a blade portion 42, a platform portion 44, and a dovetail portion 46. The rotor blade 24 can have a structure in which the platform portion 44 and the dovetail portion 46 are integrally formed, and the blade portion 42 is joined to the platform portion 44 by welding. In addition, the rotor blade 24 may integrally include the blade portion 42, the platform portion 44, and the dovetail portion 46.

The blade portion 42 has a streamlined cross-sectional shape, and extends and twists gradually while ensuring the shape. The blade portion 42 includes a base end portion fixed to the platform 44 and a tip portion extending to an inner wall surface side of a casing (not illustrated), and functions to allow the compressed air to flow smoothly.

The platform portion 44 is connected to a root side of the blade portion 42, and has a surface parallel to a centrifugal force application direction of the blade portion 42. The platform portion 44 is a base that connects the blade portion 42 and the dovetail portion 46, and is a part of an outer surface of the rotor disc 50. A part of a side surface of the platform 44 of the present embodiment faces the groove 52 of the rotor disc 50. Namely, the platform portion 44 overlaps a part of the rotor disc 50 in a radial direction of a rotation axis. The platform portion 44 is a parallel portion having a constant width in a rotation direction.

The dovetail portion 46 is connected to an end portion on a radial inner side of the platform portion 44 in a cross section in an axial view of the main shaft 32. The dovetail portion 46 is an end portion on the radial inner side of the rotor blade 24. The dovetail portion 46 includes a widened portion 60, a bottom portion 62, and a corner 64. The widened portion 60 is a portion connected to the platform 44. The widened portion 60 increases in width from the portion connected to the platform portion 44 toward the radial inner side in a cross section in an axial view of the main shaft 32. The bottom portion 62 is an end portion on the radial inner side, and a surface on the radial inner side of the bottom portion 62 faces the groove 52. The corner 64 is a connecting portion between the widened portion 60 and the bottom portion 62, and is located on the radial inner side and in an end portion in the rotation direction. The corner 64 connects the widened portion 60 and the bottom portion 62, which are surfaces forming different angles, with a circular arc in a cross section in an axial view of the main shaft 32.

A longitudinal direction of the rotor blade 24 is inclined with respect to a compressed air flow direction 56. Namely, an angle θ formed by the longitudinal direction of the rotor blade 24 and a rotation direction 54 is not an angle of 90 degrees. Therefore, the angle θ formed in the platform portion 44 and the dovetail portion 46 by end surfaces, which are surfaces facing the groove 52, and the rotation direction is not an angle of 90 degrees.

The rotor disc 50 is fixed to the main shaft 32, and rotates integrally with the main shaft 32. As described above, the groove 52 is formed in a surface on a radial outer side of the rotor disc 50. A plurality of the grooves 52 are formed in the rotor disc 50 at predetermined intervals in the rotation direction. The platform portion 44 and the dovetail portion 46 of the rotor blade 24 are inserted into the groove 52.

The groove 52 has a platform-facing portion (i.e., a platform-facing portion facing in a circumferential direction) 70, a contact portion 72, a bottom portion 74, and a connecting portion 76. The platform-facing portion 70 is an end portion on the radial outer side of the groove 52, and faces each of two end surfaces of the platform portion 44 in the rotation direction. The platform-facing portion 70 is a groove having a constant width in the rotation direction and having a constant width at positions in a radial direction of the main shaft 32. The contact portion 72 is provided on the radial inner side of the facing portion 70, and faces each of two end surfaces of the widened portion 60 in the rotation direction. The contact portion 72 is a groove that increases in width toward the radial inner side of the main shaft 32. When the rotor disc 50 rotates to apply a force to move the rotor blade 24 to the radial outer side, the contact portion 72 comes into contact with the widened portion 60 of the dovetail portion 46. The bottom portion 74 is an end portion of the groove 52 on the radial inner side of the main shaft 32. The connecting portion 76 is a connecting portion between the contact portion 72 and the bottom portion 74, and is located on the radial inner side and at an end portion of the groove 52 in the rotation direction. The connecting portion 76 connects the contact portion 72 and the bottom portion 74, which are surfaces at different angles, with a circular arc in a cross section in an axial view of the main shaft 32. The connecting portion 76 faces the corner 64 of the dovetail portion 46. The groove 52 includes a chamfered portion 78 in each of two end surfaces in the compressed air flow direction 56. The chamfer dimension of the chamfered portion 78 differs depending on a position in the groove 52. The dimension of the chamfered portion 78 will be described later.

Here, as illustrated in FIG. 4, in a radial view of the main shaft 32, an extending direction of the groove 52 is inclined along the inclination of the platform portion 44 and the dovetail portion 46 of the rotor blade 24 with respect to the compressed air flow direction 56. Namely, an angle formed by the extending direction of the groove and the rotation direction 54 is not an angle of 90 degrees. The groove 52 has a substantially parallelogram shape in a radial view of the main shaft 32, and is provided with four corners 80, 82, 84, and 86.

The corner 80 is located at a downstream end surface in the compressed air flow direction 56 and at a downstream end portion in the rotation direction 54. An angle θ1 formed at the corner 80 by the downstream end surfaces in the rotation direction 54 and in the compressed air flow direction 56 in a radial view of the main shaft 32 is an acute angle. The corner 82 is located at a downstream end surface in the compressed air flow direction 56 and at an upstream end portion in the rotation direction 54. An angle θ2 formed at the corner by the downstream end surfaces in the rotation direction 54 and in the compressed air flow direction 56 in a radial view of the main shaft 32 is an obtuse angle.

The corner 84 is located at an upstream end surface in the compressed air flow direction 56 and at an upstream end portion in the rotation direction 54. An angle $\theta_1$ formed at the corner 84 by the upstream end surfaces in the rotation direction 54 and in the compressed air flow direction 56 in a radial view of the main shaft 32 is an acute angle. The angle formed at the corner 84 is the same as the angle formed at the corner 80. The corner 86 is located at an upstream end surface in the compressed air flow direction 56 and at a downstream end portion in the rotation direction 54. An angle $\theta_2$ formed at the corner 86 by the downstream end surfaces in the rotation direction 54 and in the compressed air flow direction 56 in a radial view of the main shaft 32 is an obtuse angle. The angle formed at the corner 86 is the same as the angle formed at the corner 82.

Figure 6:
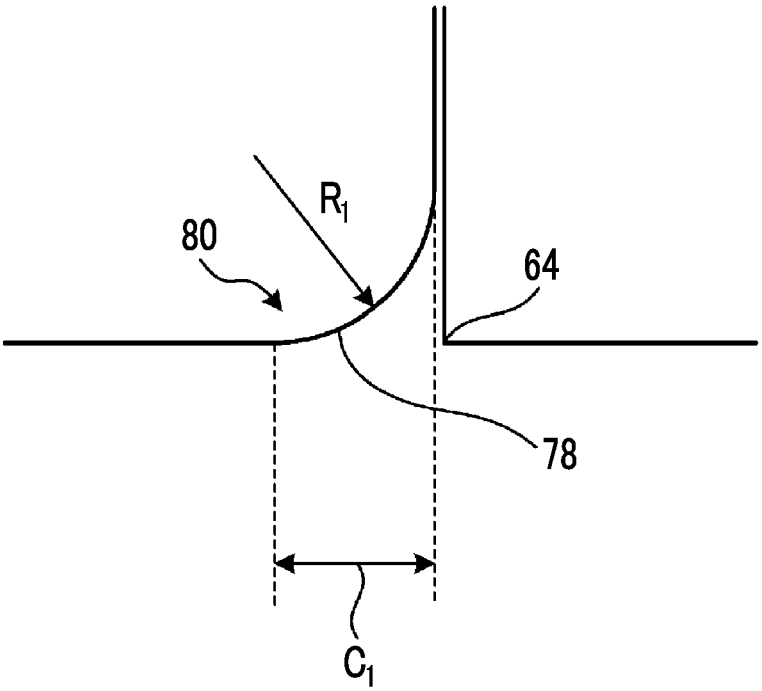
FIG. 6 is a cross-sectional view taken along line A-A in FIG. 5.
Figure 7:
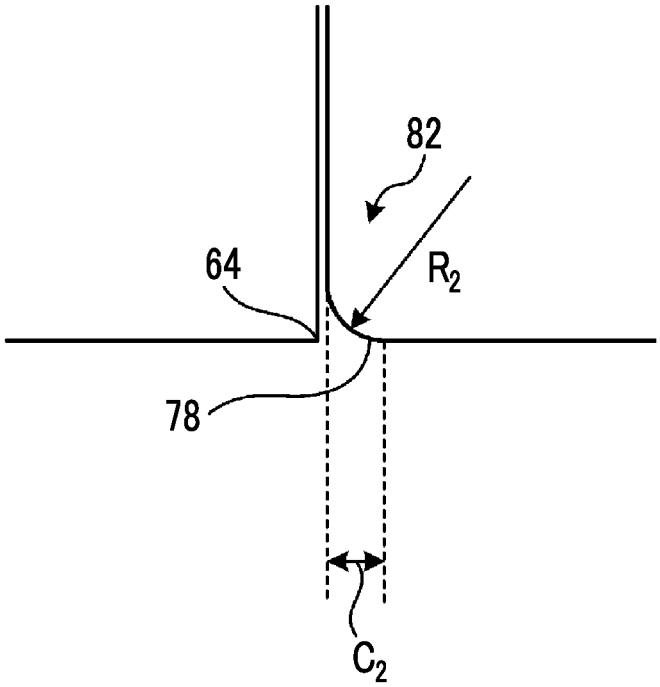
FIG. 7 is a cross-sectional view taken along line B-B in FIG. 5.

Next, the chamfered portion 78 of the groove 52 will be described with reference to FIGS. 6 and 7 in addition to FIGS. 4 and 5. FIG. 6 is a cross-sectional view taken along line A-A in FIG. 5. FIG. 7 is a cross-sectional view taken along line B-B in FIG. 5. As described above, the chamfered portion 78 is provided in each of an upstream end surface and a downstream end surface of the groove 52 in the compressed air flow direction 56. Hereinafter, the chamfered portion 78 on a downstream end surface side of the groove 52 in the compressed air flow direction 56 will be described.

As illustrated in FIGS. 4 to 7, the chamfered portion 78 is formed on the entire periphery of the groove 52, namely, in the facing portion 70, the contact portion 72, the bottom portion 74, and the connecting portion 76. As illustrated in FIGS. 6 and 7, the chamfered portion 78 has a rounded cross section. Since the chamfered portion 78 has a rounded cross section, the rotor blade 24 can be easily inserted into the groove 52. However, the chamfered portion 78 is not limited to having a rounded shape, and may have a cutout shape.

The dimension of the chamfered portion 78 differs between the corner 80 on an acute angle side and the corner 82 on an obtuse angle side. Specifically, a chamfer dimension $C_2$ (i.e., a width (chamfer width) of the chamfer when viewed in the axial direction of the rotor) of the chamfered portion 78 of the connecting portion 76 on a corner 82 side is smaller than a chamfer dimension $C_1$ of the chamfered portion 78 of the connecting portion 76 on a corner 80 side. The chamfer dimension of the connecting portion 76 is larger on a side on which the angle formed by the groove and the end surface of the rotor is an acute angle than on a side on which the angle formed by the groove and the end surface of the rotor is an obtuse angle. A radius of the rounded shape is set to different values to make the chamfered portion 78 of the present embodiment have different chamfer dimensions. A radius $R_1$ of a curved surface of the chamfered portion 78 of the connecting portion 76 on the corner 80 side is larger than a radius $R_2$ of a curved surface of the chamfered portion 78 of the connecting portion 76 on the corner 82 side. In other words, as clearly shown in FIGS. 4, 6, 7 and a chamfer dimension (i.e., a chamfer width extending from an inner surface of the groove to an axial end surface of the rotor disk when viewed in the axial direction of the rotor) of the connecting portion 76 us larger on a first circumferential side of the groove 52 on which an angle formed by the groove 52 and the axial end surface of the rotor disc 50 is an acute angle (e.g., corner 80 and 84) than in a second circumferential side of the groove 52 on which the angle formed by the groove 52 and the axial end surface of the rotor disc 50 is an obtuse angle (e.g., corner 82 and 86).

In addition, the chamfer dimension chamfer width) of the chamfered portion 78 of the facing portion 70 and the contact portion 72 on the corner 80 side is larger than the chamfer dimension (chamfer width) of the chamfered portion 78 of the facing portion 70 and the contact portion 72 on the corner 82 side. In addition, the chamfer dimension of the chamfered portion 78 of the bottom portion 74 decreases from the corner 80 toward the corner 82. The chamfer dimension of the chamfered portion 78 changes gradually. Therefore, in the chamfered portion 78, the chamfer dimension on the corner 80 side is larger than the chamfer dimension at the corner 82, and the chamfer dimension of the bottom portion 74 changes gradually as shown in FIG. 5.

The chamfered portion 78 on an upstream end surface side of the groove 52 in the compressed air flow direction 56 has the same structure. Namely, the dimension of the chamfered portion 78 on the upstream end surface side of the groove 52 in the compressed air flow direction 56 differs between the corner 84 on the acute angle side and the corner 86 on the obtuse angle side. Specifically, a chamfer dimension (width) $C_3$ of the chamfered portion 78 of the connecting portion 76 on an acute corner 84 side is larger than a chamfer dimension (chamfer width) $C_4$ of the chamfered portion 78 of the connecting portion 76 on an obtuse corner 86 side.

Since the rotor disc (rotor) 50 has a structure in which in the groove 52, the chamfer dimension $C_2$ of the chamfered portion 78 of the connecting portion 76 on the corner 82 side is smaller than the chamfer dimension $C_1$ of the chamfered portion 78 of the connecting portion 76 on the corner 80 side, the stress of the groove 52 can be prevented from being concentrated at the connecting portion 76 on the corner 80 side during rotation. In addition, since the chamfer dimension $C_2$ of the connecting portion 76 on the corner 82 side is reduced, a gap between an upstream end surface of the dovetail portion 46 in the rotation direction at which the angle is an acute angle and the connecting portion 76 can be reduced, and the occurrence of a turbulence in an air flow on the corner 82 side at an obtuse angle during rotation can be reduced. In addition, since the connecting portion 76 on the corner 80 side forms the chamfered groove portion 78 on a downstream side in the rotation direction, and a radial cross section of the corner 64 facing the connecting portion 76 is at an obtuse angle, the occurrence of a turbulence can be reduced.

In addition, since the dimension of the chamfered portion 78 of the connecting portion 76 on the corner 80 side at an acute angle is larger than the dimension of the chamfered portion 78 of the platform-facing portion 70 on the corner 82 side at an obtuse angle, stress concentration can be suppressed. In addition, since the chamfer dimension of the platform-facing portion 70 on the corner 82 side at an obtuse angle is reduced, the occurrence of a turbulence in an air flow on the corner 82 side at an obtuse angle can be reduced.

Here, it is preferable that the chamfer dimensions (chamfer width) $C_1$ and $C_3$ of the connecting portions 76 of the corners 80 and 84 on the acute angle side are 1.8 mm or more. It is preferable that the chamfer dimensions $C_2$ and $C_4$ of the connecting portions 76 of the corners 82 and 86 on the obtuse angle side are 1.7 mm or less.

Here, it is preferable that the dimension of the chamfered portion 78 of the connecting portion 78 is a dimension at a position at which a distance between the chamfered portion 78 and a facing surface of the groove 52 is at its maximum. Accordingly, stress concentration at the connecting portion 78 can be more suitably suppressed.

In addition, when the chamfered portion 78 is formed on the entire periphery of the end surface as in the present embodiment, the rotor blade 24 can be easily inserted into the groove 52.

In addition, as in the present embodiment, when the chamfered portion 78 has the structure in which the chamfer dimension from the facing portion to the connecting portion is larger on the corner 80 side at an acute angle than on the corner 82 side at an obtuse angle, the chamfered portion 78 can be easily processed.

Figure 8:
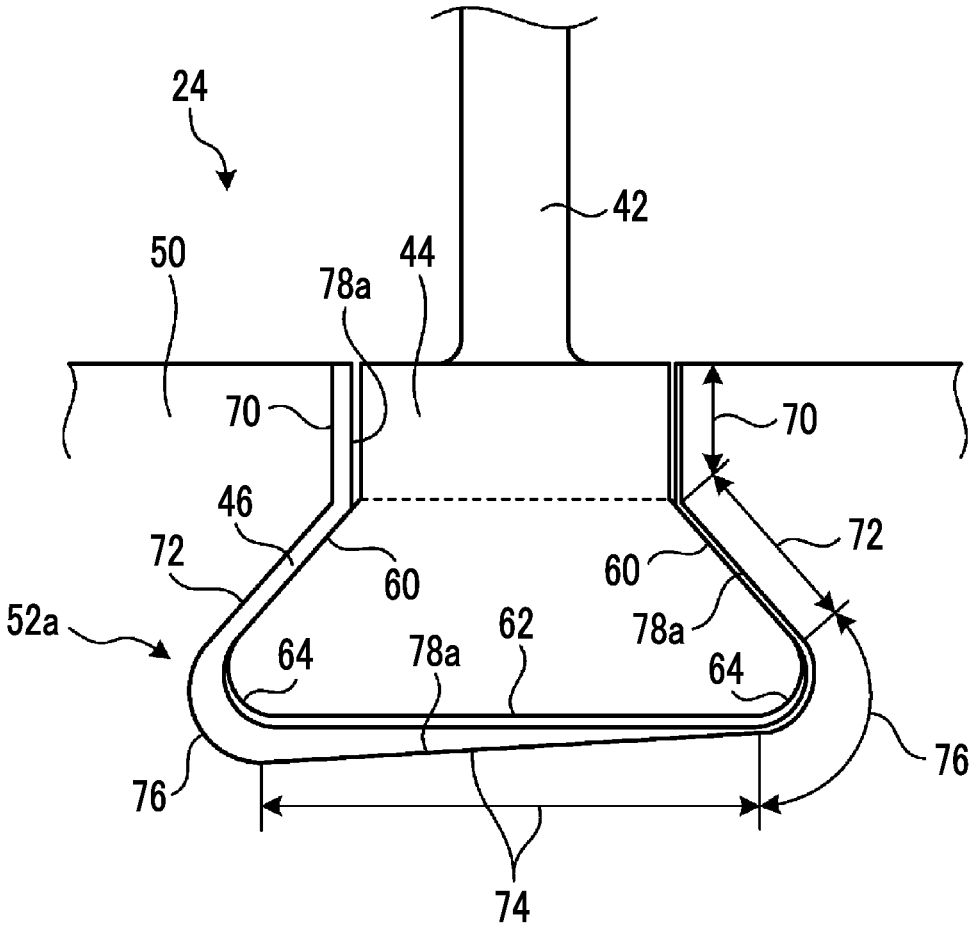
FIG. 8 is a schematic view of a dovetail portion and a groove of another example as seen in the axial direction.

FIG. 8 is a schematic view of a dovetail portion and a groove of another example as seen in the axial direction. A chamfered portion **78*a* is formed in a groove portion 52*a* illustrated in FIG. 8. The groove portion 52*a* has the same structure as that of the groove portion 52 except for a structure of the chamfered portion 78*a*. The chamfer dimensions (chamfer widths) of the chamfered portions 78*a* of the contact portion 72 and the connecting portion 76 are larger on the corner 80 side at an acute angle than on the corner 82 side at an obtuse angle. In addition, the chamfer dimensions of the chamfered portions 78*a* of the connecting portion 76 and the contact portion 74 at the corner 80 having an acute angle is larger than the chamfer dimension of the chamfered portion 78*a* of the facing portion 70 at the corner 80 having an acute angle. In addition, in the present embodiment, the chamfer dimension of the chamfered portion 78*a* of the facing portion 70 at the corner 80 having an acute angle is the same as the chamfer dimension of the chamfered portion 78*a* of the facing portion 70 at the corner 82** having an obtuse angle.

Since the chamfer dimensions of the chamfered portions **78*a* of the contact portion 72 and the connecting portion 76 are larger on the corner 80 side at an acute angle than on the corner 82 side at an obtuse angle, the occurrence of a turbulence in an air flow can be reduced while suppressing stress concentration. In addition, as in the present embodiment, when the chamfer dimensions of the connecting portion 76 and the contact portion 74 at the corner 80 having an acute angle is set to be larger than the chamfer dimension of the facing portion 70 at the corner 80 having an acute angle, namely, when the chamfer dimension of the facing portion 70 at the corner 80 having an acute angle is set to be smaller than the chamfer dimension of the connecting portion 76, an air flow at the facing portion 70** can be prevented from being turbulent.

It is preferable that the chamfered portion 78*a* has a structure in which the dimension of the connecting portion 78 on the corner 80 side at an acute angle is larger than the dimensions of other portions. Accordingly, stress concentration at the connecting portion 78 can be more suitably suppressed. In addition, in the above embodiment, the dimension of the contact portion 74 on the corner 80 side at an acute angle is the same as the dimension of the connecting portion 78 on the corner 80 side at an acute angle, but may be set to a dimension smaller than the dimension of the connecting portion 78 on the corner 80 side at an acute angle, or may decrease gradually as a distance from the connecting portion 78 increases.

In addition, it is preferable that the groove 52 has a structure in which the dimension of the chamfered portion 78*a* of the connecting portion on a side on which the angle formed by the groove 52 and the end surface is an acute angle is larger on an upstream side in the compressed air flow direction 56 than on a downstream side in the compressed air flow direction 56. Namely, it is preferable that the dimension (chamfer width) $C_3$ is set to be larger than the dimension $C_1$. Accordingly, the occurrence of a turbulence of air can be reduced while reducing stress concentration.

Figure 9:
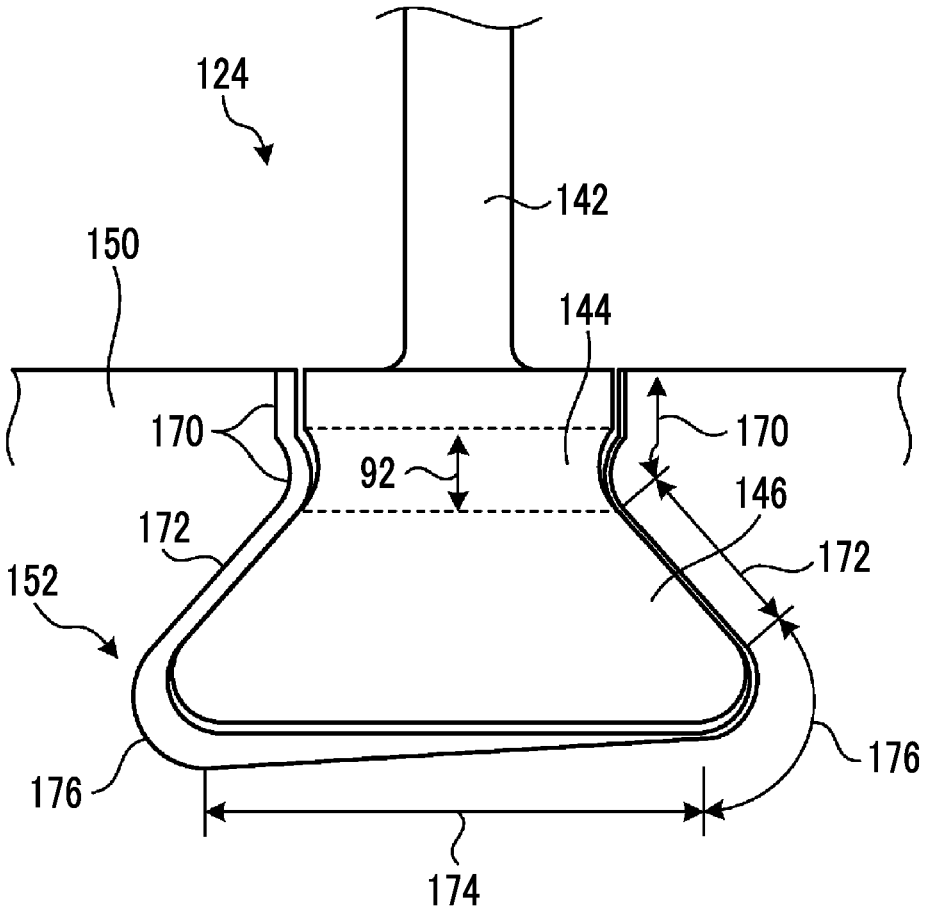
FIG. 9 is a schematic view of a dovetail portion and a groove of another example as seen in the axial direction.

FIG. 9 is a schematic view of a dovetail portion and a groove of another example as seen in the axial direction. A rotor blade 124 illustrated in FIG. 9 includes a blade portion 142, a platform portion 144, and a dovetail portion 146. The blade portion 142 and the dovetail portion 146 are the same as the blade portion 42 and the dovetail portion 46 of the rotor blade 24, respectively. The platform portion 144 includes a parallel portion having a constant width in the rotation direction, and a shank portion 92. The shank portion 92 is provided on a dovetail portion 146 side of the platform 144. The shank portion 92 is provided with a concavity having a width narrower than that of the parallel portion in a cross-sectional view seen in the axial direction. The dovetail portion 146 includes a widened portion 160, a bottom portion 162, and a corner 164.

A groove 152 includes a facing portion 170, a contact portion 172, a bottom portion 174, and a connecting portion 176. The contact portion 172, the bottom portion 174, and the connecting portion 176 have the same structures as the contact portion 72, the bottom portion 74, and the connecting portion 76 of the groove 52, respectively. The facing portion 170 has a structure in which the facing portion 170 changes in width at a position facing the shank portion 92 of the platform portion 144, and has a convex shape in a cross-sectional view seen in the axial direction.

Figure 10:
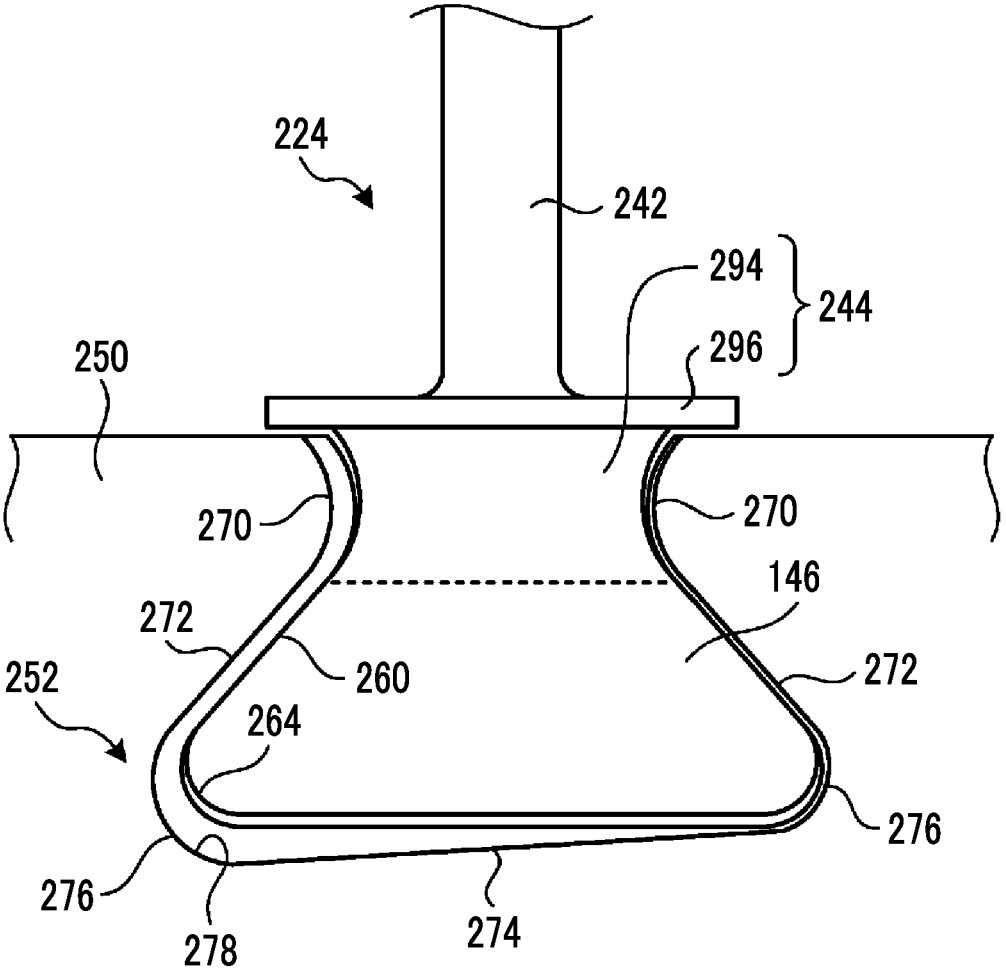
FIG. 10 is a schematic view of a dovetail portion and a groove of another example as seen in the axial direction.

FIG. 10 is a schematic view of a dovetail portion and a groove of another example as seen in the axial direction. A rotor blade 224 illustrated in FIG. 10 includes a blade portion 242, a platform portion 244, and a dovetail portion 246. The blade portion 242 and the dovetail portion 246 are the same as the blade portion 42 and the dovetail portion 46 of the rotor blade 24. The platform portion 244 includes a shank portion 294 and a parallel portion 296 having a constant width in the rotation direction. The shank portion 294 is provided on a dovetail portion 246 side of the platform 244. The shank portion 294 is provided with a concavity that decreases in width in a cross-sectional view seen in the axial direction. The parallel portion 296 is disposed outside the shank portion 294 in the radial direction, and protrudes outward from a rotor disc 250 in the radial direction. The dovetail portion 246 includes a widened portion 260, a bottom portion 262, and a corner 264.

A groove 252 includes a facing portion 270, a contact portion 272, a bottom portion 274, and a connecting portion 276. The contact portion 272, the bottom portion 274, and the connecting portion 276 have the same structures as the contact portion 72, the bottom portion 74, and the connecting portion 76 of the groove 52, respectively. The facing portion 270 has a structure in which the facing portion 270 changes in width at a position facing the shank portion 292 of the platform portion 244, and has a convex shape in a cross-sectional view seen in the axial direction.

As illustrated in FIGS. 9 and 10, the compressor 11 and the rotor disc may have a structure in which the platforms 144 and 244 are provided with the shank portions 92 and 294, respectively. The structure of the platform and the dovetail portion 46 can be various structures, and in the case of any structure, when a structure is adopted in which each portion at the corner on the acute angle side and each portion at the corner on the obtuse angle side satisfy the above relationship, the above effect can be obtained.

Figure 11:
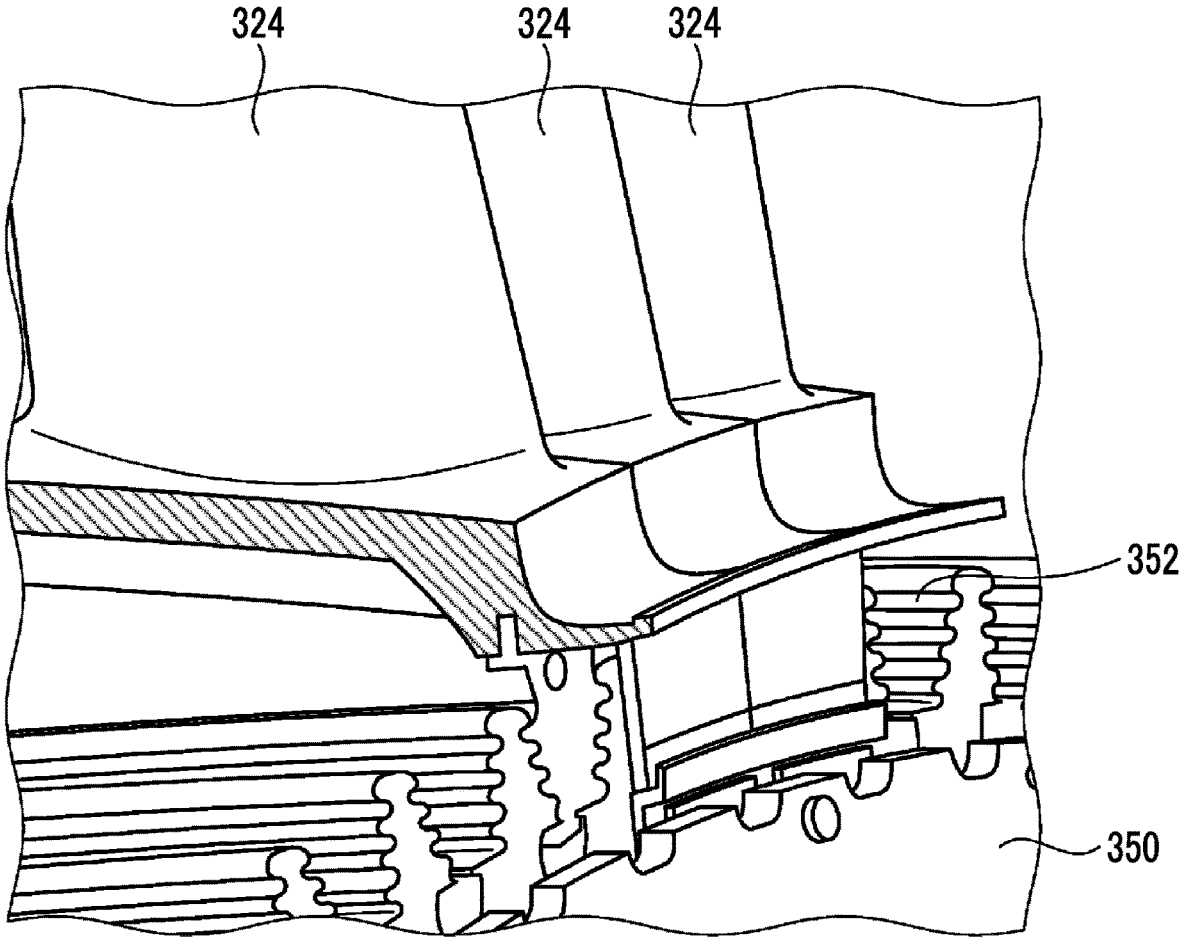
FIG. 11 is a perspective view illustrating the vicinity of rotor blades of a compressor of another example.
Figure 12:
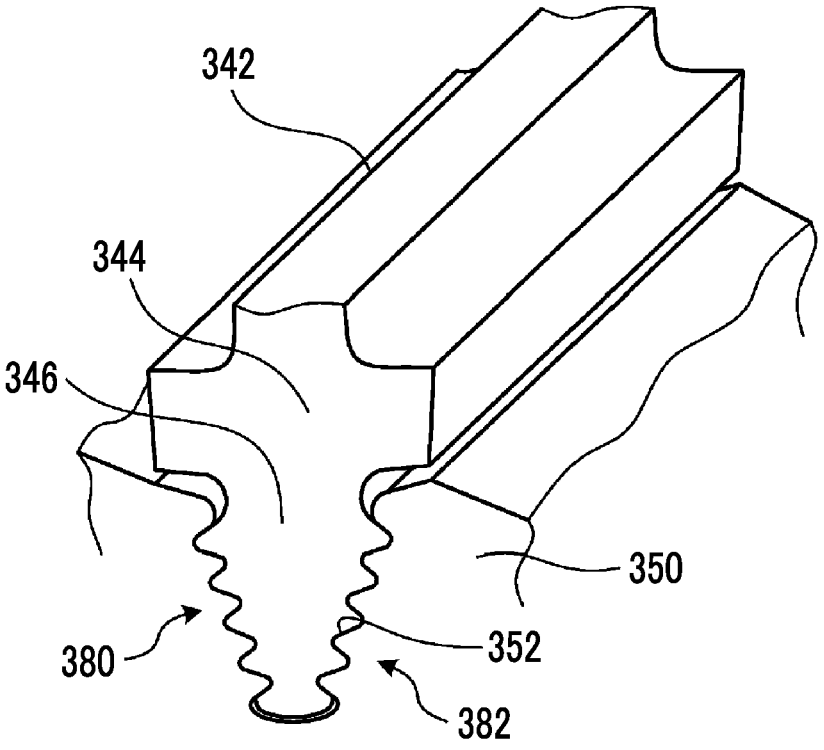
FIG. 12 is a schematic view of the compressor in FIG. 11 as seen in the axial direction.
Figure 13:
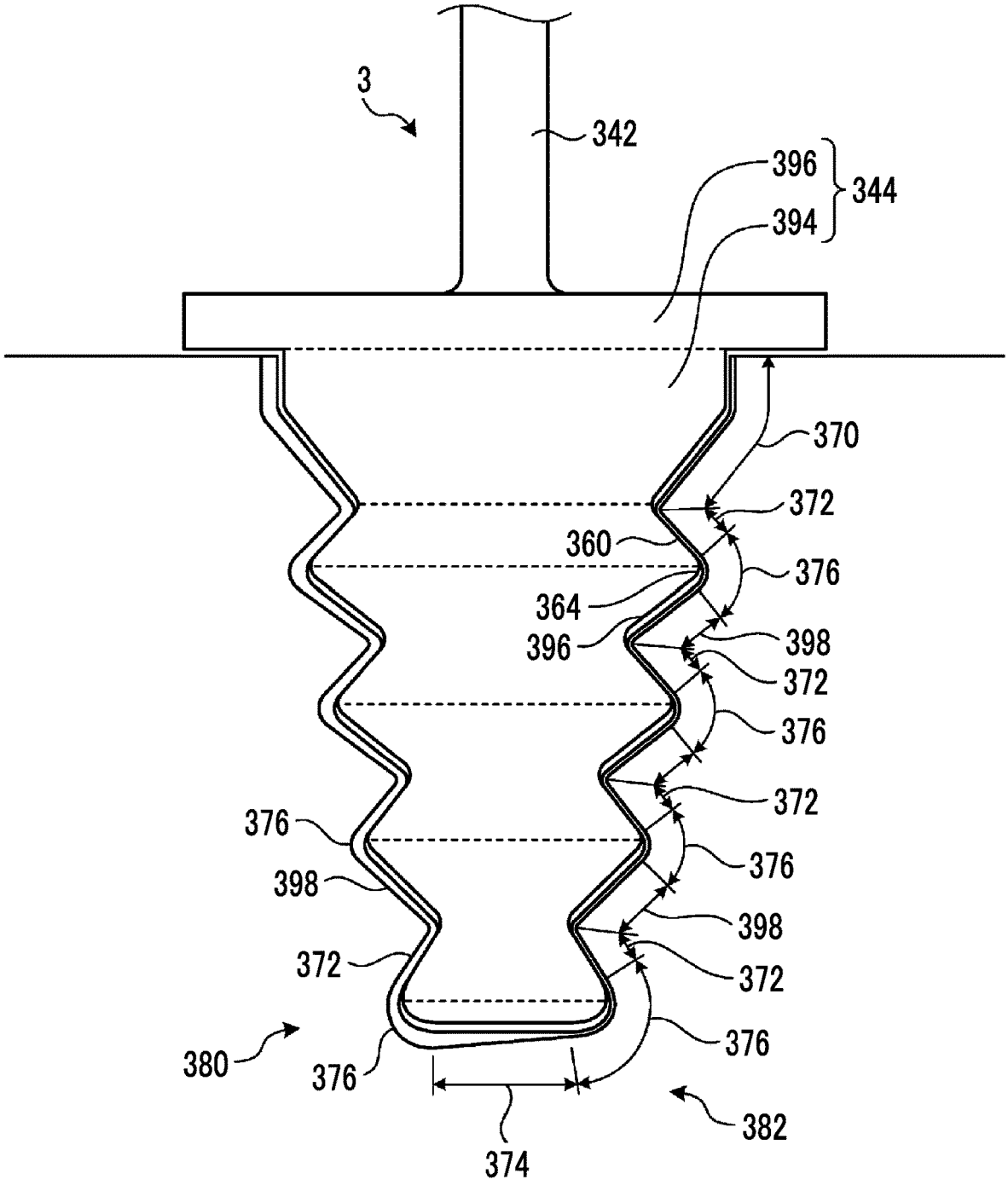
FIG. 13 is a schematic view of a dovetail portion and a groove of the compressor in FIG. 11 as seen in the axial direction.

FIG. 11 is a perspective view illustrating the vicinity of rotor blades of a compressor of another example. FIG. 12 is a schematic view of the compressor in FIG. 11 as seen in the axial direction. FIG. 13 is a schematic view of a dovetail portion and a groove of the compressor in FIG. 11 as seen in the axial direction. In the compressor illustrated in FIGS. 11 to 13, a rotor blade 324 is inserted into a groove 352 of a rotor disc 350.

The rotor blade 324 includes a blade portion 342, a platform portion 344, and a dovetail portion 346. The rotor blade 324 has a so-called Christmas tree structure in which an increase and a reduction in the width of the dovetail portion 346 are repeated a plurality of times. The blade portion 342 is the same as the blade portion 42 of the rotor blade 24.

The platform portion 344 includes an insertion portion 394 and a parallel portion 396 having a constant width in the rotation direction. The insertion portion 394 is provided on a dovetail portion 346 side of the platform 344. The insertion portion 394 has a structure in which the insertion portion 394 decreases in width toward the radial inner side in a cross-sectional view seen in the axial direction. The parallel portion 396 is disposed outside the insertion portion 394 in the radial direction, and protrudes outward from the rotor disc 350 in the radial direction.

The dovetail portion 346 includes a widened portion 360, a bottom portion 362, a corner 364, and a reduced portion 396. The widened portions 360, the corners 364, and the reduced portions 396 are provided in the dovetail portion 346 at a plurality of positions in the radial direction. The widened portion 360 has a structure in which the widened portion 360 increases in width toward the radial inner side. The reduced portion 396 has a structure in which the reduced portion 396 decreases in width toward the radial inner side. The corner 364 connects an end portion on the radial inner side of the widened portion 360 and an end portion on the radial outer side of the reduced portion 396. In addition, the corner 364 connects the widened portion 360 and the bottom portion 362.

In the dovetail portion 346, from the radial outer side toward the radial inner side, the widened portion 360, the corner 364, the reduced portion 396, the widened portion 360, the corner 364, and the reduced portion 396 are disposed in order, and end portions of the widened portion 360, the corner 364, and the bottom portion 362 on the radial inner side are disposed in order.

The groove 352 includes a facing portion 370, a contact portion 372, a bottom portion 374, a connecting portion 376, and a non-contact portion 398. A plurality of the contact portions 372, the connecting portions 376, and the non-contact portions 398 are disposed in the radial direction of the main shaft 32. The facing portion 370 is disposed at a position to face the insertion portion 394 of the platform 344. The contact portion 372 is disposed at a position to face the widened portion 360 of the dovetail portion 346. The bottom portion 374 is disposed at a position to face the bottom portion 362 of the dovetail portion 346. The connecting portion 376 is disposed at a position to face the corner 364. The non-contact portion 398 is disposed at a position to face the reduced portion 396. Namely, the groove 352 has a multi-stage structure in which the non-contact portion 398 is provided inside the connecting portion 376 in the radial direction of the main shaft 32, the contact portion 372 is provided inside the non-contact portion 398 in the radial direction of the main shaft 32, and the plurality of contact portions 372 are disposed in the radial direction.

The groove portion 352 is provided with a chamfered portion 378.

Similarly to the above embodiment, the chamfer dimension of the chamfered portion 378 differs between a corner 380 on the acute angle side and a corner 382 on the obtuse angle side. Specifically, at least the chamfer dimension of the chamfered portion 378 of the connecting portion 376 at the corner 380 on the acute angle side is larger than the chamfer dimension of the chamfered portion 378 of the connecting portion 376 at the corner 382 on the obtuse angle side. Namely, in the groove portion 352, the chamfer dimension at the position of a concave portion on a corner 380 side on the acute angle side is relatively large, and the chamfer dimension at the position of a concave portion on a corner 382 side on the obtuse angle side is relatively small, so that the occurrence of a turbulence in an air flow can be reduced while suppressing stress concentration.

In addition, in the above-described embodiment, the rotor according to the present invention has been described as being applied to the compressor 11 of the gas turbine, but may be applied to the turbine 13. In addition, the present invention is not limited to being applied to the gas turbine, and can be applied to other rotary machines such as steam turbines.

REFERENCE SIGNS LIST

11: Compressor
12: Combustor
13: Turbine
24: Rotor blade
32: Main shaft
42: Blade portion
44: Platform portion
46: Dovetail portion
50: Rotor disc (rotor)
52: Groove
54: Rotation direction
56: Compressed air flow direction
60: Widened portion
62: Bottom portion
64: Corner
70: Facing portion (platform-facing portion)
72: Contact portion
74: Bottom portion
76: Connecting portion
78: Chamfered portion
80, 82, 84, 86: Corner

The invention claimed is:

1. A rotor comprising:

a rotor blade including a dovetail portion, a platform portion connected to the dovetail portion, and a blade portion; and a rotor disc having a groove configured to mesh with the rotor blade, the rotor disc defining an axial direction with respect to a rotational axis of the rotor disc, a radial direction with respect to a radius of the rotor disc, and a circumferential direction with respect to a circumference of the rotor disc, wherein the groove includes:

a contact portion open at an axial end surface of the rotor disc on a plane intersecting the rotational axis of the rotor disc, the contact portion extending at an inclined angle with respect to the rotational axis, and increasing in width toward a rotor radial inner side to be in contact with the dovetail portion of the rotor blade, a bottom portion forming an end portion of the groove on the rotor radial inner side, a connecting portion between the contact portion and the bottom portion, a platform-facing portion located on a rotor radially-outer side of the contact portion to face the platform portion of the rotor blade, and a chamfered portion formed at an axial end of the groove and having a chamfer width, the chamfer width being defined as a distance between a first end of the chamfer portion at an inner surface of the groove and a second end of the chamfer portion at the axial end surface of the rotor disc when viewed in an axial direction of the rotor disc, wherein the chamfer width of the chamfered portion of the connecting portion when viewed in an axial direction of the rotor is larger on a first circumferential side of the groove on which an angle is formed by the inner surface of the groove and the axial end surface of the rotor disc is an acute angle than on a second circumferential side of the groove on which an angle formed by the inner surface of the groove and the axial end surfce of the rotor disc is an obtuse angle.

2. The rotor according to claim 1, wherein the chamfer width of the chamfered portion of the connecting portion on the first circumferential side of the groove on which the angle formed by the groove and the axial end surface of the rotor disc is an acute angle is larger than a chamfer width of the chamfered portion of the platform-facing portion on the first circumferential side of the groove on which the angle formed by the groove and the axial end surface of the rotor disc is an acute angle.

3. The rotor according to claim 1, wherein the chamfer width of the chamfered portion of the connecting portion on the first circumferential side of the groove on which the angle formed by the groove and the axial end surface of the rotor disc is an acute angle is larger on an upstream side in a gas flow direction than on a downstream side in the gas flow direction.

4. The rotor according to claim 1, wherein the chamfer width of the chamfered portion of the connecting portion is a dimension at a position at which a distance between the chamfered portion and a facing surface of the groove is larger than at any other position.

5. The rotor according to claim 1, wherein the chamfered portion is formed on an entire periphery of the axial end of the groove.

6. The rotor according to claim 5, wherein the chamfer width of the chamfered portion of the connecting portion on the first circumferential side on which the angle formed by the groove and the axial end surface of the rotor disc is an acute angle is larger than the chamfer width of the chamfered portions of other portions.

7. The rotor according to claim 1, wherein a chamfer width of the chamfered portion of both the contact portion and the connecting portion are larger on the first circumferential side of the groove on which the angle formed by the groove and the axial end surface of the rotor disc is an acute angle than on the second circumferential side of the groove on which the angle formed by the groove and the axial end surface of the rotor disc is an obtuse angle.

8. The rotor according to claim 1, wherein a chamfer width of a section of the chamfered portion extending from the platform-facing portion to the connecting portion is larger on the first circumferential side of the groove on which the angle formed by the groove and the axial end surface of the rotor disc is an acute angle than on the second circumferential side of the groove on which the angle formed by the groove and the axial end surface of rotor disc is an obtuse angle.

9. The rotor according to claim 1, wherein the platform-facing portion includes a shape facing a shank portion of the rotor blade between the platform portion and the dovetail portion.

10. The rotor according to claim 1, wherein the groove further includes a non-contact portion on the rotor radial inner side of the connecting portion, and the contact portion is located on the rotor radial inner side of the non-contact portion.

11. A compressor comprising:

a main shaft; and the rotor according to claim 1 mounted on the main shaft;

wherein the rotor blade of the rotor has a blade root engaging with the rotor.

12. The compressor according to claim 11, wherein the platform portion of the rotor blade is connected to a root side of the blade portion and has a surface parallel to a centrifugal force application direction of the blade portion, and the dovetail portion of the rotor blade is a connected to the platform portion and disposed on a radial inner side of the platform portion, a dovetail portion, a platform portion connected to the dovetail portion, and a blade portion.

* * * * *